United States Patent [19]

Kobayashi et al.

[11] 4,177,069

[45] Dec. 4, 1979

[54] PROCESS FOR MANUFACTURING SINTERED COMPACTS OF ALUMINUM-BASE ALLOYS

[75] Inventors: Mituki Kobayashi; Takao Awao; Yujiro Mizusaki; Kunio Sato; Akio Kato, all of Kawahigashimura; Hisao Mituishi, Tokyo, all of Japan

[73] Assignee: Showa Denko K.K., Tokyo, Japan

[21] Appl. No.: 892,740

[22] Filed: Apr. 3, 1978

[30] Foreign Application Priority Data

Apr. 9, 1977 [JP] Japan ..... 52-40827
Apr. 9, 1977 [JP] Japan ..... 52-40828

[51] Int. Cl.[2] ..... B22F 1/00

[52] U.S. Cl. ..... 75/213; 75/200; 75/206; 75/212; 75/224; 75/227; 75/249; 148/126

[58] Field of Search ..... 75/200, 206, 212, 224, 75/227, 249, 213; 148/126

[56] References Cited

U.S. PATENT DOCUMENTS

| | | | |
|---|---|---|---|
| 3,004,331 | 10/1961 | Towner et al. | 75/249 |
| 3,144,330 | 8/1964 | Storchheim | 75/200 |
| 3,536,458 | 10/1970 | Storchheim | 75/249 X |
| 3,754,905 | 8/1973 | Knopp | 75/200 |
| 3,791,800 | 2/1974 | McGee | 75/249 X |
| 3,841,846 | 10/1974 | Larsen et al. | 75/200 |
| 3,950,165 | 4/1976 | Oda et al. | 75/200 |
| 3,960,606 | 1/1976 | Chia et al. | 75/249 X |
| 4,135,922 | 1/1979 | Cebulak | 75/249 X |

OTHER PUBLICATIONS

*Metal Progress Data Sheet,* "Selecting Wrought Aluminum Alloys" *Metal Progress,* Oct. 1967, p. 142A.

*Primary Examiner*—Richard E. Schafer
*Attorney, Agent, or Firm*—Kane, Dalsimer, Kane, Sullivan & Kurucz

[57] ABSTRACT

Process for manufacturing sintered compacts of aluminum-base alloys having contents of Si, Cu and Mg, which comprises, mixing an aluminum powder and/or an Al-Si alloy powder with at least one powder of Al-Cu-Mg-Si, Al-Cu-Mg and so on in such a proportion, that the former will amount to 70% or more, based on the total weight of the resulting powder mixture, and that the over-all composition of the resulting powder mixture will lie essentially in the range of 1.0~6.0% by weight of Cu, 0.2~2.0% by weight of Mg, 0.2~2.0% by weight of Si and rest of Al, compacting the so obtained powder mixture into shapes and then sintering the so obtained green compacts in the air.

15 Claims, No Drawings

PROCESS FOR MANUFACTURING SINTERED COMPACTS OF ALUMINUM-BASE ALLOYS

BACKGROUND OF THE INVENTION

The present invention relates to a process for manufacturing sintered compacts from metal powder having predominant constituent of Al.

Aluminum-base metal sintered compacts have found many practical uses for various machine parts, since they are light in weight, reveal higher strength and show high anti-corrosive property. In manufacturing these aluminum-base sintered compacts, it is required to sinter the metal powder of aluminum or of aluminum alloy at higher temperature such as 500°~600° C. If the surface oxidation of the metal particles proceeds during the period of heating up to the sintering temperature or the period of sintering, the binding force between the particles next to each other becomes weak and the strength of the sintered compact decreases. In order to prevent such surface oxidation of the metal particles, it has heretofore been practised to carry out the sintering in a non-oxidizing environment such as in an inert gas or in vacuum. However, in preparing the sintering atmosphere to be non-oxidizing, the costs for the manufacturing equipments and for the operation become considerably high, so that it will be impossible to provide sintered products at lower price. It has thus recently been demanded earnestly to develop and establish a process for manufacturing aluminum-base alloy sintered compacts in which the sintering can be accomplished in the air without necessitating the preparation of special sintering atmosphere.

As to the process for manufacturing sintered compact of aluminum-base alloy in which the sintering is carried out in the air, a process has already been proposed by S. Storchheim according to U.S. Pat. No. 3,687,657, in which, using a powder mixture prepared by admixing a small amount of magnesium powder and/or zinc powder to aluminum powder, a low melting eutectic of aluminum with magnesium or with zinc is formed during the course of heating of the powder mixture up to the sintering temperature and thus the surface of particle of aluminum powder is covered with this eutectic, whereby the oxidation of surface of aluminum particles during the sintering is prevented.

While it is in fact possible by this process to carry out the sintering in the air, it has been recognized according to the experiments conducted by us, that the sintered compacts obtained by this process revealed only low age hardening effect, as the experiments showed that sintered compacts thus obtained exhibited, after they had been subjected to solution heat treatment and subsequent quenching followed by an artificial age hardening, only low tensile strength of about 20 kg/mm$^2$ or so. It was furthermore disclosed by our experiments, that an enough mechanical strength was never attainable by said proposed process, so long as extremely fine starting powder was not employed. Thus, for example, it was by all means required, to use for the aluminum powder those which contain 35~95% or more of a fine particle fraction with particle size passing completely 350-mesh of Tyler standard sieve, necessitating at the same time to adopt other additive metal powder also in size all passing through the 350-mesh sieve. Thus, in the process according to the proposal of S. Storchheim, it is not only of disadvantage, that the starting powder is costly in price, but it is also problematic, that the worse flowability of the powder due to its extremely fine particle size will result in a retardation of velocity for charging the die in the compacting procedure, whereby the productivity is decreased.

In order to increase the mechanical strengths of the sintered compacts of aluminum-base alloys, a possibility of addition of an element contributive to the precipitation hardening of the aluminum matrix, such as, silicon, copper and so on, may be expected as a countermeasure. Among these additive elements, silicon may particularly be assumed to contribute greatly to the precipitation hardening. As for the practical method of addition of silicon, admixing of powdery simple substance of silicon to the starting powder may be considered at the first place. According to the experiments performed by us, however, it has been revealed, that the rate of diffusion of silicon is so low that the silicon particles are retained as such in the sintered body even after a considerable duration of sintering and thus a contribution by the precipitation hardening cannot be expected but, on the contrary, even a decrease in the strength may be observed.

As another method of addition of silicon, there may be considered to admix a powder of Al-Si alloy to the starting powder. In general, however, the compactibility in compacting the metal powder is worse for powder of alloy having higher silicon content. Therefore, if a large amount of Al-Si alloy powder having higher content of silicon is added, the green compact will not sufficiently be densified during the compacting procedure, so that there may occur a danger of progress of internal oxidation upon sintering in the air.

SUMMARY OF THE INVENTION

The first object of the present invention is thus, to make possible of obtaining high strength sintered compacts of aluminum-base alloy by sintering in the air without necessitating preparation of specific sintering atmosphere, so as to thereby achieve decrease of the costs for manufacture.

The second object of the present invention is to attain utilization of coarse starting powder, such as the per se employment of powder produced by, for example, atomization, so as to thereby lower the production cost of starting powder.

The third object of the present invention is in correlation with the above first object and is to propose a method for attaining an increase of the effect of precipitation hardening by adding silicon with copper and magnesium.

In order to achieve these objects, the present invention proposes a process for manufacturing sintered compacts of aluminum-base alloys comprizing a step (1) of mixing at least one powder selected from the first group consisting of aluminum powder and powder of Al-Si alloy containing Si at the most of 2.1% by weight with at least one powder selected from the second group consisting of Al-Cu-Mg-Si alloy powder, Al-Cu-Si alloy powder, Al-Mg-Si alloy powder, Cu-Mg-Si alloy powder, Al-Cu-Mg alloy powder, Al-Cu alloy powder, Al-Mg alloy powder, Mg-Cu alloy powder, Cu powder and Mg powder in such a mixing proportion, that the overall composition of the so obtained powder mixture corresponds essentially to the figures of Cu 1.0~6.0% by weight
Mg 0.2~2.0% by weight
Si 0.2~2.0% by weight Al Rest and wherein the powder of said first group will amount to at least 70%, based on the total weight of the resulting powder mixture; a step (2) of compacting the resulting said powder mixture into predetermined shapes to obtain green compacts and a step (3) of sintering the said green compacts at a temperature of from 500° to 650° C. in the air.

DETAILED DESCRIPTION OF THE INVENTION

The starting powders to be employed in the process according to the present invention are classified into two groups, i.e. the first and the second groups. The powders of the first group provides the sintered compact with the predominent component, i.e. aluminum, or with aluminum and silicon among the subsidiary components. The first group includes powder of pure aluminum metal and powder of Al-Si alloy with Si-content of 0.3~2.1% by weight. These powders show both better compactibility, i.e. better shaping ability upon the press forming in the later process step.

The powders of the second group provide the sintered compact with subsidiary components in minor amount, and the second group includes powder of Al-Cu-Mg-Si alloy, powder of Al-Cu-Si alloy, powder of Al-Mg-Si alloy, powder of Cu-Mg-Si alloy, powder of Al-Cu-Mg alloy, powder of Al-Cu alloy, powder of Al-Mg alloy, powder of Cu-Mg alloy, powder of Cu metal and powder of Mg metal. All these powders exhibit inferior compactibility as compared to those of the first group.

In the first step of the process according to the present invention, at least one of the powders of the first group, i.e. Al powder and/or Al-Si alloy powder is compounded with one or two or more of the powders of the second group and mixed together. The mixing proportion for each powder is determined, irrespective of whether the powder is of simple substance or of alloy, in such a manner, that the content of each element with respect to the entire powder mixture will correspond to the figures of 1.0~6.0% by weight of Cu, 0.2~2.0% by weight of Mg, 0.2~2.0% by weight of Si and the rest of Al and wherein the powder of first group will amount to at least 70%, preferably at least 87%, based on the total weight of the powder mixture.

In combining the powders of first group with that of second group, it is practiced for example, when Al powder is chosen from the first group, an alloy powder containing Si or a combination of a Si-containing alloy powder with other powder may be selected from the second group. Examples for such combination may be:

(a) Al with Al-Cu-Mg-Si alloy
(b) Al with Al-Cu-Si alloy and Mg
(c) Al with Al-Mg-Si alloy and Cu
(d) Al with Cu-Mg-Si alloy When Al-Si alloy powder is chosen from the first group, it is able to select an alloy powder having no Si content and/or a simple substance metal powder from the second group. Some examples for such combination may be recited as follows:

(e) Al-Si alloy with Cu and Mg
(f) Al-Si alloy with Al-Cu-Mg alloy
(g) Al-Si alloy with Al-Cu alloy and Al-Mg alloy
(h) Al-Si alloy with Cu-Mg alloy It is of course possible to incorporate Cu powder and/or Mg powder in addition to each of the above combinations for the purpose of adjusting the composition of the mixture.

If the content of Si in the Al-Si alloy powder exceeds the value of 2.1%, there appears a fear of insufficient compacting due to the decrease of compactibility of Al-Si alloy powder and, in addition, there occurs further a danger of deformation of the sintered compact, since the liquid phase of Al-Cu-Mg-Si alloy, which is a low melting alloy, becomes superfluous upon the diffusion of Cu and Mg into the Al-Si alloy during the sintering period. Therefore, it is necessary to employ and Al-Si alloy powder having content of alloyed Si at the most of 2.1% by weight.

In the case that the powder selected from the second group has no Si content, if the Si content in the Al-Si alloy powder of first group is less than the value of 0.3% by weight, it will be impossible to attain an effect of the precipitation hardening by Si as will be described in below, since the Si content in the sintered compact obtained decreases. In such a case, it is necessary to employ and Al-Si alloy powder containing at least 0.3% by weight of Si. Of course, it is able to adopt an alloy powder of Al-Si concurrently with the use of a powder having alloyed Si content among those of the second group. In such a case, it may be possible to employ as Al-Si powder containing less than 0.3% by weight of Si. It is moreover possible to use both Al powder and Al-Si alloy powder in the first group.

Each of the powders in the second group shows an inferior compactibility as compared to those of the first group. Therefore, if the proportion in the total powder mixture allotted by the powders of second group exceeds the value of 30% by weight, the compact formed in the later process step will not sufficiently be densified, so that a large amount of air (containing oxygen) is retained within the green compact and at the same time there are many open pores communicating to the outer atmosphere formed. Consequently, the internal oxidation will proceed during the operation of sintering and thus a sufficient mechanical strength will not be attained. Therefore, the mixing proportion of the powder of first group with that of second group should be determined, so as to amount the powder of first group to the value of at least 70% and preferably at least 87% by weight.

As to the starting powders for, such as, Al powder and Al-Si powder, it is able to employ coarser powder than in the prior technique. For example, a powder produced by atomization and having particle size about in the range of all passing through 48-mesh of Tyler standard sieve can be used per se. Even by using such coarse powders, it is possible by the process according to the present invention to reach a sufficient mechanical strength as will be explained in later on. While, on the surface of the particle of Al powder or Al-Si alloy powder produced by atomization method, there is formed in general a thin oxide skin layer, an oxide skin layer of such thickness can be destroyed easily by the compacting procedure, as described in below, so that the mechanical strength of the resulting sintered compact will scarecely be decreased by the use of such powders as obtained by atomization.

The powder mixture which has been prepared as above is then charged into a compacting die such as metal die to compact into a predetermined shape. As to the means for this compacting, it is possible to utilize known press machine. Over the inside surface of the compacting die, there is coated preliminarily with a lubricant. As for the lubricant, such as for example, a solution prepared by dissolving zinc stearate, lithium stearate or aluminum stearate in carbon tetrachloride, lubricant oils of mineral nature and of vegetable nature and so on may be used. It is desirable however, not to admix any lubricant to the powder mixture.

In the compacting procedure, it is desirable to press the powder mixture, so as to attain a density of green compact obtained reaching to about 90~99% and preferably to 95% or more of the theoretical density. Since the powder mixture contains Al powder and/or Al-Si powder exhibiting better compactibility as described previously in an amount of at least 70% by weight, it shows better compactibility as compared to the prior technique, so that it has now been made possible only by employing relatively low pressure, for example, 3~4 ton/cm$^2$ or so, to densify up to the value of 98~99% of the theoretical density.

The green compact prepared as above is now sintered in the air at a temperature from 500° to 650° C., preferably from 530° to 600° C. If the rate of elevation of the temperature of green compact up to the sintering temperature is low, the internal oxidation can proceed in some extent during the course of the temperature elevation, so that it is desirable to keep the rate of temperature elevation as high as possible. In order to increase the rate of temperature elevation, it may be recommended to take a measure in such a manner, that the internal temperature of the sintering furnace is settled at the sintering temperature before hand and then the green compact is charged quickly in this furnace. Though the duration of sintering may be different depending upon the sintering temperature, it is sufficient in general to choose a time of over 5 minutes and in many cases about 30 minutes or so.

It is not desirable from the point of view of prevention of internal oxidation to subject the green compact to a preliminary heating at a temperature beneath the sintering temperature before sintering.

The sintered compact obtained after the sintering step is then subjected to a thermal treatment same as in the ordinary treatment for aluminum drawn material, for example, so-called $T_6$ treatment (solution heat treatment, quenching and age hardening) etc., in order to effect a precipitation hardening. It is desirable to accomplish the solution heat treatment by maintaining the sintered compact at a temperature of 480°~520° C. for about 30 minutes. The age hardening is effected preferably by keeping the sintered compact at 150°~200° C. for 10~20 hours.

In the step of compacting of the powder mixture in the process according to the present invention, the thin oxide skin layer over the surface of each particle of Al powder and/or Al-Si alloy powder is destroyed by the force of pressing imparted onto the particles, whereby fresh genuine metal surface of each particles will be exposed, so that particles of Al powder and/or Al-Si alloy powder will come to contact directly with their genuine metal surfaces each other and, at the same time, they will also come to contact with the particles of second group powders, such as Al-Cu-Mg alloy powder etc., directly by their naked surfaces. Because of that over 70% by weight of the powder mixture are constituted from the powder of first group showing better compactibility, the green compact obtained by this step is sufficiently densified internally, so that the air occluded within the compact becomes decreased and also the occurrence of the open pore communicating to the outer atmosphere will be suppressed. For these reasons, progress of internal oxidation while elevating the temperature up to the sintering temperature or during the sintering is prevented. Thus on reaching to the sintering temperature, the elements Cu, Mg and/or Si contained in the particles of second group powder will diffuse into the particles of Al powder and/or Al-Si alloy powder of the first group through the area of direct contact of the metal surfaces each other, to thereby proceed the solid phase sintering. Simultaneously, also between the particles of the first group powders, a solid phase sintering proceeds through the metal/metal contact face. When low melting alloy, such as Al-Cu-Mg-Si, Al-Mg-Si,Al-Cu-Si or so on, is employed for the powder of second group, a liquid phase is given from said low melting alloy at the sintering temperature, so that a liquid phase sintering also commences concurrently with the solid phase sintering. Therefore, if high melting metal powders, such as Cu powder, Mg powder and so on, are included besides the above low melting powder, they are diffused promptly through the liquid phase into the particle body of the first group powder. Even when a low melting alloy powder fusible at the sintering temperature is not used in the second group powder, so long as, for example, Cu-Mg alloy powder is employed for the second group powder, a low melting eutectic alloy, such as Al-Cu-Mg-Si or so on, can be formed at the neighborhood of the border of adjacent particles through the diffusion of Cu and Mg by a solid phase sintering process, whereby a slight formation of liquid phase occurs on the border of particles during the sintering and through this liquid phase, the diffusion of Cu, Mg and/or Si into the internal solid of particle of the first group powder proceeds rapidly. Thus, in all cases, though possible of difference in the degree, a liquid phase sintering will proceed at least partly in addition to the solid phase sintering, so that a sintered compact in which Si, Cu and Mg are distributed homogeneously within the aluminum matrix can rapidly be obtained.

The over-all composition of thus obtained sintered compact excluding the superficial thin oxide layer coincides substantially with that of raw powder mixture. Therefore, the composition of the sintered compacts manufactured by the process according to the present invention comes essentially under the figures: 1.0~6.0% by weight of Cu, 0.2~2.0% by weight of Mg, 0.2~2.0% by weight of Si and rest Al. Among these elements, copper will contribute to the reinforcement of the aluminum matrix through precipitation hardening and solution strengthening. When the content of copper is short of 1.0%, no effect on the strengthening of the aluminum matrix will be brought forth and, if it exceeds 6.0%, the sintered compact becomes embrittled and, in addition, an abnormal growth or expansion apt to occur during the sintering. Magnesium also contributes to the strengthening of the aluminum matrix by precipitation hardening. Magnesium in an amount less than 0.2% offers no effect on the strengthening and, when exceeding 2.0%, will bring about an embrittlement of the sintered compact obtained. Silicon contributes markedly to the strengthening of the aluminum matrix owing to the precipitation hardening, wherein however, an amount less than 0.2% offers almost no effect on the strengthening and an amount exceeding 2.0% causes an embrittlement of the sintered compact and at the same time produces a tendency to cause abnormal growth during the sintering.

It is possible to add upon requirement iron, nickel, chromium, manganese, cobalt, molybdenum, titanium and so on besides the above elements copper, magnesium and silicon. Iron dissolves scarecely in aluminum but forms an iron compound, decreasing the elongation and toughness of the sintered product, however, if there exists silicon concurrently, the solubility of iron is increased and the proof stress of the sintered product is augmented. However, the range of content of iron, in which these effects can be attained, lies between about 0.2% and 1.5% by weight. The mechanical strengths of the sintered product in higher temperature region can be augmented without increasing the susceptibility to the stress corrosion cracking, by adding nickel, chromium, manganese, cobalt, molybdenum or so on each in an amount of about 0.02~0.5%. However, if toughness should be taken into account, it is desirable to limit the total amount of these elements to a value of about 1.0% by weight or the less. An addition of titanium offers an effect of grain refining and the amount of addition thereof may preferably be in the range from 0.005 to 0.25% by weight.

It would be preferred, that these additive metals, such as iron, nickel etc., are admixed previously to the alloy powder of the second group, such as Al-Cu-Mg-Si or Al-Mg-Si, in the form of alloyed element, so as to be compounded as alloy powder. In this way, it would be able to attain a homogeneous and prompt dispersion of iron, nickel and so on, which are difficult to diffuse in the particle of aluminum as solid phase of metal simple substance, within the aluminum particles and/or Al-Si alloy particle, since they will diffuse in the particles of aluminum and/or Al-Si alloy powder accompanying with the diffusion of copper, magnesium and silicon during the sintering.

In the following, examples of practical execution of the process according to the present invention are given, in which Examples 1 to 9 represent embodiments using Al powder for the first group and Examples 10 to 15 exemplify the employment of Al-Si alloy powder for the first group. In the each Example, the particle size of powder is expressed in every case by the Tyler standard.

The $T_6$-treatment in each Example was carried out in such a manner, that the solution treatment was kept at 500° C. for 30 minutes followed by a water quenching and subsequent age hardening at 165° C. for 18 hours.

EXAMPLE 1

As the raw powder mixture there were employed aluminum powder produced by atomization and powder of alloy of 40% Cu - 5% Mg - 8% Si - Al, compounded in such a proportion, that the over-all composition of the resulting powder mixture corresponded to the figure: 4.0% Cu - 0.5% Mg - 0.8% Si - Al. The particle size distribution, mixing ratio in weight basis, and the apparent density of these powders were as given in Table 1.

Table 1

| Component of powder mixture | | Al | Al-Cu-Mg-Si |
|---|---|---|---|
| Size distribution | −48 + 100 mesh | 4.4% | 1.8% |
| | −100 + 145 mesh | 8.1% | 4.4% |
| | −145 + 200 mesh | 19.5% | 9.0% |
| | −200 + 250 mesh | 21.6% | 11.5% |
| | −250 + 350 mesh | 7.2% | 10.0% |
| | −350 | 39.2% | 62.3% |
| Apparent density | | 1.05 g/cm$^3$ | 1.45 g/cm$^3$ |

Table 1-continued

| Component of powder mixture | Al | Al-Cu-Mg-Si |
|---|---|---|
| Mixing ratio in weight | 90% | 10% |

The above two powders were mixed together for about 30 minutes and the resulting mixture was charged in a metal die, the internal surface of which had been coated preliminarily with a lubricant consisting of saturated solution of zinc stearate in carbon tetrachloride. Using a press machine, the powder mixture charged in the die was compacted to obtaine a green compact exhibiting a density of 98.2% of the theoretical value. The dimensions of this green compact was the same with the tensile test specimen of JSPM standard 2–64. One green compact obtained as above was then placed in a boat made of stainless steel (SUS 304) and charged rapidly together with the boat into a uniformaly heating device kept preliminarily at a temperature of 540° C. in the sintering furnance and thus the sintering was conducted for 5 minutes. Another green compact also obtained as above was subjected to sintering in the same manner but for 30 minutes. For these sintered compacts, a tensile test was made, which showed that the specimen subjected to 5 minutes' sintering exhibited a tensile strength of 21.5 kg/mm$^2$ and an elongation of 4.8% and that the specimen subjected to 30 minutes' sintering showed a tensile strength of 23.8 kg/mm$^2$ and an elongation of 5.6%. Both sintering compacts exhibited better surface condition and no fault was recognized.

When the same sintered compact subjected to the 30 minutes' sintering was further treated by $T_6$-treatment, a tensile strength of 34.0 kg/mm$^2$ was obtained.

EXAMPLE 2

95 parts by weight of an aluminum powder and 5 parts by weight of an alloy powder of 40% Cu - 10% Mg - 12% Si - Al, both of which showed particle size distribution and apparent density nearly equal to those in Example 1, were mixed together and, by processing as in Example 1, a sintered compact having a composition corresponding to 2.0% Cu - 0.5% Mg - 0.6% Si - Al was obtained. The condition of sintering was 590° C. and 30 minutes. The density of this sintered compact reached to 94.2% of the theoretical value and it showed a tensile strength of 22.7 kg/mm$^2$ and an elongation of 13.9%. When the same sintered compact was subjected to $T_6$-treatment, a tensile strength of 34.3 kg/mm$^2$ was attained.

EXAMPLE 3

94.2 parts by weight of aluminum powder and 5.8 parts by weight of an alloy powder of 60% Cu - 10% Mg - 8% Si - Al, both having size distribution and apparent density nearly equal to those in Example 1, were mixed together and, by processing as in Example 1, a sintered compact having a composition of 3.5% Cu - 0.58% Mg - 0.46% Si - Al was obtained. The sintering condition was selected to be 570° C. and 30 minutes. By conducting tensile strength test for this sintered compact, a tensile strength of 24.6 kg/mm$^2$ and an elongation of 8.2% were observed. When the same sintered compact was further subjected to $T_6$-treatment, a tensile strength of 34.8 kg/mm$^2$ was reached.

EXAMPLE 4

92.5 parts by weight of aluminum powder and 7.5 parts by weight of alloy powder of 60% Cu - 6.7% Mg - 5.3% Si - Al, both having size distribution and apparent density almost equal to those in Example 1, were admixed together and, by following same procedures as in Example 1, a sintered compact with a composition of 4.5% Cu - 0.50% Mg - 0.40% Si - Al was obtained. The sintering condition was selected to be 560° C. and 30 minutes. The tensile test with this sintered compact gave a tensile strength of 21.8 kg/mm$^2$ and an elongation of 2.9%. Same sintered compact was further subjected to $T_6$-treatment with the result of tensile strength of 38.3 kg/mm$^2$.

EXAMPLE 5

92.7 parts by weight of aluminum powder having size distribution and apparent density nearly equal to those in Example 1, 5.0 parts by weight of an alloy powder of 50% Cu - 8% Si - Al, 0.3 part by weight of magnesium powder and 2 parts by weight of another alloy powder of 10% Mg - 15% Si - Cu were mixed together and, by following the same procedures as in Example 1, a sintered compact with a composition of 4.0% Cu - 0.51% Mg - 0.69% Si - Al was obtained. The sintering condition was 560° C.×30 minutes. The tensile test for this sintered compact gave a tensile strength of 21.5 kg/mm$^2$ and an elongation of 6.3%. A $T_6$-treatment made for same sintered compact brought to a tensile strength of 34.2 kg/mm$^2$.

EXAMPLE 6

89.2 parts by weight of Al powder having nearly same particle size distribution and apparent density with that employed in Example 1 were mixed together with 5.0 parts by weight of an alloy powder of 60.6% Cu - 9.8% Mg - 7.6% Si - Al, 5.0 parts by weight of another alloy powder of 44.0% Cu - 8.2% Si - Al and 0.8 part by weight of an electrolytic copper powder composed of minus 350-mesh and having an apparent density of 1.66 g/cm$^3$. By following same procedures as in Example 1, a sintered compact having a composition of 6.0% Cu - 0.49% Mg - 0.8% Si - Al was obtained. The sintering condition was 560° C.×30 minutes. By conducting a tensile test for this sintered compact, it was recognized that this specimen had a tensile strength of 24.0 kg/mm$^2$ and an elongation of 2.2%. A $T_6$-treatment made for same sintered compact brought to a tensile strength of 33.1 kg/mm$^2$.

EXAMPLE 7

An aluminum powder having nearly same size distribution and apparent density with that employed in Example 1, an alloy powder of 44% Cu - 8.0% Si - Al and a magnesium powder composed of 100% of minus 350-mesh and having an apparent density of 0.64 g/cm$^3$ were mixed together at a mixing proportion in weight basis of 89.5%:10.0%:0.5% respectively. By following same procedures as in Example 1, a sintered compact having a composition of 4.4% Cu - 0.5% Mg - 0.8% Si - Al was obtained. The sintering condition was 570° C.×30 minutes. The tensile test made for this sintered compact gave a tensile strength of 20.6 kg/mm$^2$ and an elongation of 2.5%. By a $T_6$-treatment made for same sintered compact, a tensile strength of 32.5 kg/mm$^2$ was reached.

EXAMPLE 8

An aluminum powder exhibiting nearly same particle size distribution and apparent density with that employed in Example 1, an alloy powder of 24.0% Mg - 20.0% Si - Al and an electrolytic copper powder composed of 100% of minus 200-mesh and having an apparent density of 1.66 g/cm$^3$ were mixed together at a mixing proportion in weight basis of 94.0%:2.5%:3.5% respectively. By following same procedures as in Example 1, a sintered compact having a composition of 3.5% Cu - 0.5% Mg - 0.6% Si - Al was obtained. The sintering condition was 580° C.×30 minutes. The tensile test made for this specimen gave a tensile strength of 21.2 kg/mm$^2$ and an elongation of 5.0%. By a $T_6$-treatment, the tensile strength thereof reached to 33.1 kg/mm$^2$.

EXAMPLE 9

An aluminum powder having nearly same size distribution and apparent density with that employed in Example 1 and an alloy powder of 10% Mg - 15% Si - Cu composed from 100% of minus 200-mesh and exhibiting an apparent density of 1.30 g/cm$^3$ were mixed together in a weight proportion of 96%:4% respectively. By pursuing same procedures as in Example 1, a sintered compact having a composition of 3.0% Cu - 0.4% Mg - 0.6% Si - Al was obtained. The sintering condition was 580° C.×30 minutes. The tensile test made for this specimen gave a tensile strength of 21.0 kg/mm$^2$ and an elongation of 6.2%. Same sintered compact was further subjected to $T_6$-treatment whereby a tensile strength of 33.6 kg/mm$^2$ was reached.

The results obtained in the above Examples 1 to 9 are summarized in Table 2.

Table 2

| Ex. | Starting powder component | Mixing ratio in weight basis (%) | Composition of sintered compact (wt. %) Cu | Mg | Si | Al |
|---|---|---|---|---|---|---|
| 1 | Al | 90.0 | | | | |
| | Al-40%Cu-5%Mg-8%Si | 10.0 | 4.0 | 0.5 | 0.8 | Rest |
| 2 | Al | 95.0 | | | | |
| | Al-40%Cu-10%Mg-12%Si | 5.0 | 2.0 | 0.5 | 0.6 | " |
| 3 | Al | 94.2 | | | | |
| | Al-60%Cu-10%Mg-8%Si | 5.8 | 3.5 | 0.58 | 0.46 | " |
| 4 | Al | 92.5 | | | | |
| | Al-60%Cu-6.7%Mg 5.3%Si | 7.5 | 4.5 | 0.50 | 0.40 | " |
| 5 | Al | 92.7 | | | | |
| | Al-50%Cu-8%Si | 5.0 | | | | |
| | Mg | 0.3 | 4.0 | 0.51 | 0.69 | " |
| | Cu-10%Mg-15%Si | 2.0 | | | | |
| 6 | Al | 89.2 | | | | |
| | Al-60.6%Cu-9.8%Mg-7.6%Si | 5.0 | | | | |
| | Al-44.0%Cu-8.2%Si | 5.0 | 6.0 | 0.49 | 0.80 | " |
| | Cu | 0.8 | | | | |
| 7 | Al | 89.5 | | | | |
| | Al-44%Cu-8.0%Si | 10.0 | 4.4 | 0.50 | 0.80 | " |
| | Mg | 0.5 | | | | |
| 8 | Al | 94.0 | | | | |
| | Al-24%Mg-20%Si | 2.5 | 3.5 | 0.50 | 0.60 | " |
| | Cu | 3.5 | | | | |
| 9 | Al | 96.0 | | | | |
| | Cu-10%Mg-15%Si | 4.0 | 3.0 | 0.40 | 0.60 | " |

| Example | Sintering condition: 30 min. at (°C.) | Characteristic properties of sintered compact* S | E | $S_T$ |
|---|---|---|---|---|
| 1 | 540 | 21.2 | 4.8 | 34.0 |
| 2 | 590 | 22.7 | 13.9 | 34.3 |
| 3 | 570 | 24.6 | 8.2 | 34.8 |
| 4 | 560 | 21.8 | 2.9 | 38.3 |
| 5 | 560 | 21.5 | 6.3 | 34.2 |
| 6 | 560 | 24.0 | 2.2 | 33.1 |
| 7 | 570 | 20.6 | 2.5 | 32.5 |
| 8 | 580 | 21.2 | 5.0 | 33.1 |
| 9 | 580 | 21.0 | 6.2 | 33.6 |

*S: Tensile strength kg/mm$^2$
$S_T$: Tensile strength after $T_6$-treatment kg/mm$^2$
E: Elongation %

EXAMPLE 10

As starting powder, an alloy powder of 0.84% Si - Al prepared by atomization, an electrolytic copper powder and a magnesium powder were employed and were mixed together in such a proportion, that the over-all composition of the resulting powder mixture corresponded to 4.4% Cu - 0.5% Mg - 0.8% Si - Al. The particle size distribution, the mixing ratio in weight and apparent density basis were as given in Table 3.

Table 3

| Component of powder mixture | | Al-0.84%Si | Cu | Mg |
|---|---|---|---|---|
| | −48 + 100 | 6.8% | — | — |
| Particle | −100 + 145 | 13.1% | — | — |
| size | −145 + 200 | 18.0% | — | — |
| disti- | −200 + 250 | 11.3% | — | — |
| bution | −250 + 350 | 7.2% | — | — |
| (mesh) | −350 | 43.6% | 100% | 100% |
| Apparent density (g/cm$^3$) | | 41.13 | 1.66 | 0.64 |
| Mixing ratio in wt. | | 95.4% | 4.4% | 0.5% |

The alloy powder of 0.84% Si - Al employed had been treated before the mixing, by annealing at a temperature of 350° C. for 2 hours in the air. The mixing of these three powders was continued for 30 minutes and, by pursuing the procedures of Example 1, sintering was carried out. The sintering condition was 560° C.×30 minutes. The tensile test made for the sintered compact obtained showed a tensile strength of 24.6 kg/mm$^2$ and an elongation of 6.3%. The surface condition of this specimen was satisfactory. On the other hand, a sintered compact, which was prepared by the same procedures as above except that the duration of sintering was 20 minutes, was subjected further to $T_6$-treatment before it was examined by a tensile test. The tensile strength observed was 35.1 kg/mm$^2$.

EXAMPLE 11

Using two alloy powders of 0.4% Si - Al and of 40% Cu - 5% Mg - Al as starting powder components, the two were mixed together in such a proportion, that the over-all composition of the resulting powder mixture was brought to the figure of 4.0% Cu - 0.5% Mg - 0.36% Si - Al. The particle size distribution, apparent density and the mixing ratio in weight basis were as given in Table 4.

Table 4

| Component of powder mixture | | Al-0.4%Si | Al-40%Cu-5%Mg |
|---|---|---|---|
| | −48 + 100 mesh | 11.4% | 2.0% |
| | −100 + 145 mesh | 10.1% | 4.5% |
| Size | −145 + 200 mesh | 16.2% | 8.8% |

Table 4-continued

| Component of powder mixture | | Al-0.4%Si | Al-40%Cu-5%Mg |
|---|---|---|---|
| distri- | −200 + 250 mesh | 13.5% | 13.4% |
| bution | −250 + 350 mesh | 7.4% | 8.0% |
| | −350 mesh | 41.4% | 63.3% |
| Apparent density (g/m$^3$) | | 1.13 | 1.44 |
| Mixing ratio in wt. basis | | 90% | 10% |

The mixing of these powders, compacting of the mixture and sintering of the green compact were carried out as in Example 10. The tensile test made for the specimen obtained by sintering at 580° C. for 20 minutes gave a tensile strength of 20.9 kg/mm$^2$ and an elongation of 7.5%. Another sintered compact prepared in the same way was further subjected to $T_6$-treatment before it was examined by tensile test. The tensile strength observed was 32.7 kg/mm$^2$.

EXAMPLE 12

Using three alloy powders of 0.75% Si - Al, of 80% Cu - Al and of 60% Mg - Al for the starting powder components, the three were mixed together in a mixing ratio given in Table 5, which had resulted in an over-all composition of 5.0% Cu - 0.4% Mg - 0.7% Si - Al. Here the alloy powder of 0.75% Si - Al exhibited a size distribution and an apparent density nearly equal to those of the alloy powder of 0.84% Si - Al in Example 10.

Table 5

| Component of powder mixture | | Al-0.75%Si | Al-80%Cu | Al-60%Mg |
|---|---|---|---|---|
| | −48 + 100 mesh | 8.7% | 4.2% | 9.1% |
| | −100 + 145 mesh | 13.4% | 5.2% | 10.5% |
| Size | −145 + 200 mesh | 15.0% | 7.9% | 13.9% |
| distri- | −200 + 250 mesh | 13.1% | 15.3% | 14.2% |
| bution | −250 + 350 mesh | 8.5% | 7.0% | 7.3% |
| | −350 mesh | 41.3% | 60.4% | 45.0% |
| Apparent density (g/cm$^3$) | | 1.13 | 1.50 | 0.86 |
| Mixing ratio in wt. basis | | 93.1% | 6.25% | 0.67% |

Using these three powders, the mixing and compacting were carried out as in Example 1. The tensile test made for the specimen obtained by sintering at 570° C. for 30 minutes gave a tensile strength of 22.1 kg/mm$^2$ and an elongation of 4.0%. After $T_6$-treatment made for another specimen, which was prepared in the same way except that the sintering was carried out at 580° C. for 30 minutes, a tensile strength of 33.5 kg/mm$^2$ was observed.

EXAMPLE 13

Using two alloy powders, i.e. 0.62% Si - Al alloy and 11.8% Mg - Cu alloy, the two powders were compounded at the mixing ratio given in Table 6, so as to obtain an over-all composition of 3.0% Cu - 0.4% Mg - 0.6% Si - Al.

Table 6

| Component of powder mixture | | Al-0.62%Si | Cu-11.8%Mg |
|---|---|---|---|
| | −48 + 100 mesh | 10.9% | — |
| | −100 + mesh | 11.1% | — |
| Size | −145 + 200 mesh | 13.9% | — |
| distri- | −200 + 250 mesh | 14.0% | — |
| bution | −250 + 350 mesh | 7.6% | — |
| | −350 mesh | 42.5% | 100% |
| Apparent density (g/cm$^3$) | | 1.13 | 1.51 |
| Mixing ratio in wt. basis | | 96.6% | 3.4% |

The mixing of these powders and the compacting were carried out as in Example 1. The tensile test made for the specimen obtained after sintering at 570° C. for 30 minutes gave a tensile strength of 20.7 kg/mm² and an elongation of 9.6%. Another specimen prepared in the same way but sintered at 580° C. for 30 minutes was treated by $T_6$-treatment. This specimen showed a tensile strength of 35.2 kg/mm².

EXAMPLE 14

As the starting powder components there were used a powder of 0.75% Si - Al alloy, a powder of 60% Cu - 10% Mg - Al alloy, copper powder and magnesium powder. These four powders were compounded at a mixing ratio given in Table 7, so as to obtain an over-all composition of 4.0% Cu - 0.6% Mg - 0.7% Si - Al.

Table 7

| Component of powder mixture | | Al-0.75% Si | Al-60%Cu-10%Mg | Cu | Mg |
|---|---|---|---|---|---|
| | −48 + 100 mesh | 6.7% | 1.5% | — | — |
| | −100 + 145 mesh | 10.2% | 4.0% | — | — |
| | −145 + 200 mesh | 14.0% | 9.6% | — | — |
| Size | −200 + 250 mesh | 15.7% | 13.2% | — | — |
| distri- | −250 + 350 mesh | 8.3% | 8.6% | — | — |
| bution | −350 mesh | 45.1% | 63.1% | 100% | 100% |
| Apparent tensity (g/cm³) | | 1.13 | 1.47 | 1.66 | 0.64 |
| Mixing ratio in wt. basis | | 93.9% | 5% | 1% | 0.1% |

The mixing of these powders and the compacting of the mixture were carried out as in Example 1. A tensile test was made for the sintered compact sintered at 570° C. for 30 minutes, which gave a tensile strength of 22.1 kg/mm² and an elongation of 7.5%. Another sintered compact prepared in the same way and sintered also in the same condition was treated by $T_6$-treatment. This specimen showed a tensile strength of 34.5 kg/mm².

EXAMPLE 15

As the starting powder components there were used a powder of 6.52% Si - Al alloy, a powder of 7% Mg - Cu alloy and magnesium powder. These three powders were compounded at a mixing ratio given in Table 8, so as to attain an overall composition of 2.7% Cu - 0.7% Mg - 0.5% Si - Al.

Table 8

| Component of powder mixture | | Al-0.52%Si | Cu-7%Mg | Mg |
|---|---|---|---|---|
| | −48 + 100 mesh | 10.9% | — | — |
| | −100 + 145 mesh | 8.3% | — | — |
| Size | −145 + 200 mesh | 15.9% | — | — |
| distri- | −200 + 250 mesh | 14.1% | — | — |
| bution | −250 + 350 mesh | 7.6% | — | — |
| | −350 mesh | 43.2% | 100% | 100% |
| Apparent density (g/cm³) | | 1.10 | 1.53 | 0.64 |
| Mixing ratio in wt. basis | | 96.6% | 2.9% | 0.5% |

These powders were mixed and then compacted by the same procedures as in Example 1. By the tensile test made for the specimen sintered at 570° C. for 30 minutes, a tensil strength of 20.6 kg/mm² and an elongation of 12.5% were observed. After $T_6$-treatment made for another specimen prepared in the same way and sintered also at the same condition, i.e. 570° C. for 30 minutes, the specimen showed a tensile strength of 35.2 kg/mm².

The results obtained in Examples 10 to 15 are summarized in Table 9.

Table 9

| Example | Starting powder component | Mixing ratio (wt. %) | Composition of sintered compact (wt. %) Cu | Mg | Si | Al |
|---|---|---|---|---|---|---|
| | Al-0.84%Si | 95.4 | | | | |
| 10 | Cu | 4.4 | 4.4 | 0.5 | 0.8 | Rest |
| | Mg | 0.5 | | | | |
| 11 | Al-0.4%Si | 90 | | | | |
| | Al-40%Cu-5%Mg | 10 | 4.0 | 0.5 | 0.36 | " |
| | Al-0.75%Si | 93.1 | | | | |
| 12 | Al-80%Cu | 6.25 | 5.0 | 0.4 | 0.7 | " |
| | Al-60%Mg | 0.67 | | | | |
| | Al-0.62%Si | 96.6 | | | | |
| 13 | Cu-11.8%Mg | 3.4 | 3.0 | 0.4 | 0.6 | " |
| | Al-0.75%Si | 93.9 | | | | |
| 14 | Al-60%Cu-10%Mg | 5.0 | 4.0 | 0.6 | 0.7 | " |
| | Cu | 1.0 | | | | |
| | Mg | 0.1 | | | | |
| | Al-0.52%Si | 96.6 | | | | |
| 15 | Cu-7%Mg | 2.9 | 2.7 | 0.7 | 0.5 | " |
| | Mg | 0.5 | | | | |

| Example | Sintering temperature (°C.) | Characteristic properties of the sintered compact* S | E | ST |
|---|---|---|---|---|
| 10 | 560 | 24.6 | 6.3 | 35.1 |
| 11 | 580 | 20.9 | 7.5 | 32.7 |
| 12 | 570 ~ 580 | 22.1 | 4.0 | 33.5 |
| 13 | 570 ~ 580 | 20.7 | 9.6 | 35.2 |
| 14 | 570 | 22.1 | 7.5 | 34.5 |
| 15 | 570 | 20.6 | 12.5 | 35.2 |

*S, ST and E correspond to Table 2.

As is evident from these Examples, it was now made possible to manufacture sintered compacts, which can attain, after an age hardening, a considerably high tensile strength of such as 32~34 kg/mm² or higher, in the air by the process according to the present invention. Thus, according to the process of the present invention, it has been made possible, firstly, to reach a high density of the green compact, by restricting the mixing proportion of total of the powders showing inferior compactibility, such as alloy powder of Al-Cu-Mg-Si, copper powder and magnesium powder, under 30% and, secondly, to utilize sufficiently the effect of precipitation hardening caused from Si, by incorporating an Al-Si alloy having low Si content only in an amount smaller than 30% or by employing an alloy, which contains Si alloyed with Cu and/or Mg, so as to attain a rapid and homogeneous dispersion of Si into the aluminum matrix, and thus, by the combination of the precipitation hardening effects by silicon, copper and magnesium with the solution strengthening by copper and magnesium, it has been made possible to attain high strength even by the sintering in the air. Therefore, the process according to the present invention can most pertinently be applied for manufacturing sintered products such as machine parts requiring high strength and light weight.

The process according to the present invention also offers another advantage, that it dispenses with the use of a special atmospheric gas or vacuum condition resulting in a lowering of the operation cost with concomitant decrease of the cost for manufacturing equipment.

Moreover, according to the process of this invention, it is able to use coarse powder having particle size of, for example, minus 48-mesh or so for the main raw material, i.e. Al powder and/or Al-Si alloy powder, so that powders obtained by atomization can be employed per se therefor, whereby a further economization of operation cost can be attained. Thus, by the process according to the present invention, the work and cost for preparing the starting powder can considerably be spared as compared to the prior process. Furthermore, the work of mixing of powders can be eased and the flowability of the powder is improved, so that the velocity of charging in the compacting becomes high with the result of increase of productivity.

Summarily, the present invention offers a process which permits manufacturing of high strength sintered products of aluminum-base alloys at substantially lower cost with the simultaneous improvement of the productivity.

Thus, the present invention has been described in detail with reference to many specific Examples, however, it should be noted that the present invention, so long as the scope defined by the appended claims or the spirit described in the specification is not exceeded, would not be restricted by such Examples and each specific illustration.

What is claimed is:

1. Process for manufacturing sintered compacts of aluminum-base alloys comprizing a step of mixing at least one powder selected from the first group consisting of aluminum powder and powder of Al-Si alloy containing Si at the most of 2.1% by weight with at least one powder selected from the second group consisting of powders of Al-Cu-Mg-Si alloy, Al-Cu-Si alloy, Al-Mg-Si alloy, Cu-Mg-Si alloy, Al-Cu-Mg alloy, Al-Cu alloy, Al-Mg alloy, Mg-Cu alloy, Cu and Mg in such a mixing proportion, that the over-all composition of the resulting powder mixture will correspond to the figures Cu 1.0~6.0% by weight
Mg 0.2~2.0% by weight
Si 0.2~2.0% by weight
Al Rest and wherein the powder of said first group will amount to at least 70%, based on the total weight of the resulting powder mixture; a step of compacting the resulting powder mixture into predetermined shapes to obtain green compacts and a step of sintering the green compacts at a temperature of from 500° to 650° C. in the air.

2. The process according to claim 1, wherein the powder selected from the first group is aluminum powder and the at least one powder selected from the second group includes at least one alloy powder containing alloyed Si.

3. The process according to claim 1, wherein the powder selected from the first group is Al-Si alloy powder and said at least one powder selected from the second group does not include the powder containing alloyed Si.

4. The process according to claim 3, wherein said Al-Si alloy powder contains at least 0.3% of Si.

5. The process according to claim 1, wherein both aluminum powder and Al-Si alloy powder are selected from the first group.

6. The process according to claim 1, wherein said at least one powder selected from the first group and said at least one powder selected from the second group are compounded in the step of mixing in such a proportion, that the first group powder will amount to at least 87% of the mixture.

7. The process according to claim 1, wherein the powder mixture is compressed in the step of compacting, so as to reach a density of the green compact of 90~99% of the theoretical density.

8. The process according to claim 1, wherein the compacting is carried out avoiding the mixing of lubricant with the powder mixture.

9. The process according to claim 8, wherein the internal surface of the compacting die is coated preliminary with lubricant.

10. The process according to claim 1, wherein the sintering is carried out at a temperature of from 530° C. to 600° C.

11. The process according to claim 1, wherein the sintered compact obtained from the step of sintering is further treated by solution treatment followed by quenching and subsequent age hardening.

12. The process according to claim 1, wherein Fe is added preliminarily in an alloyed form to at least one powder of the second group employed to obtain the powder mixture in such an amount, that the content thereof will amount to 0.2~1.5% based on the total weight of the powder mixture.

13. The process according to claim 1, wherein at least one element selected from the group of Ni, Cr, Mn, Co and Mo is added preliminarily in an alloyed form to at least one powder of said second group employed to obtain the powder mixture in such an amount, that each content thereof will be 0.02~0.5% based on the total weight of the powder mixture, wherein however, the total content thereof will be kept below 1.0%.

14. The process according to claim 1, wherein Ti is added preliminarily in an alloyed form to at least one powder of said second group employed to obtain the powder mixture in such an amount, that it will amount to 0.005~0.25%, based on the total weight of the powder mixture.

15. The process according to claim 1, wherein powders having particle size all passing through 48-mesh Tyler standard sieve obtained by atomization are employed per se for the powder of said first group.

* * * * *